US006484635B2

(12) United States Patent
Burke et al.

(10) Patent No.: US 6,484,635 B2
(45) Date of Patent: Nov. 26, 2002

(54) VARIABLE-WIDTH SPRAY APPLICATOR FOR A PRINTING PRESS

(75) Inventors: David Charles Burke, Portsmouth, NH (US); Matthew Todd Boyer, Portsmouth, NH (US); Clifford Allen Zabkar, Dover, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/725,617

(22) Filed: Nov. 29, 2000

(65) Prior Publication Data

US 2002/0062754 A1 May 30, 2002

(51) Int. Cl.[7] ..... B41F 35/06
(52) U.S. Cl. ..... 101/424; 101/425
(58) Field of Search ..... 101/424, 425, 101/423; 15/256.51, 256.52, 256.53; 34/153, 157, 168 R

(56) References Cited

U.S. PATENT DOCUMENTS 2,791,174 A * 5/1957 Kock ..... 101/147
3,924,531 A * 12/1975 Klinger ..... 101/147
4,831,927 A * 5/1989 Lin ..... 101/148
5,257,578 A 11/1993 Jackson et al. ..... 101/425
5,259,313 A 11/1993 Gibson et al. ..... 101/425
5,299,495 A * 4/1994 Schoeps et al. ..... 101/147
5,388,510 A * 2/1995 Hansson ..... 101/147
5,490,459 A 2/1996 Hoff ..... 101/423

FOREIGN PATENT DOCUMENTS

| | | |
|---|---|---|
| DE | 943112 | 5/1956 |
| DE | 9109721 | 11/1991 |
| EP | 0618074 | 10/1994 |

* cited by examiner

*Primary Examiner*—Andrew H. Hirshfeld
*Assistant Examiner*—Anthony H. Nguyen
(74) *Attorney, Agent, or Firm*—Davidson, Davidson & Kappel, LLC

(57) ABSTRACT

A device for providing cleaning or other solution in a printing press including a spraying device, the spraying device having a liquid exit disposed along a width of the spraying device for delivering a liquid to a press component and a spray shield selectively covering at least one part of the liquid exit so as to block delivery of the liquid through the at least one part to the press component. Also disclosed is a method for providing cleaning or other fluid to a printing press component comprising the steps of spraying a fluid over a fixed width of a press component, and blocking part of the fluid over a part of the fixed width so that the part of the fluid does not reach the press component.

14 Claims, 4 Drawing Sheets

VARIABLE-WIDTH SPRAY APPLICATOR FOR A PRINTING PRESS

BACKGROUND OF THE INVENTION

1. Field of the Invention

The present invention relates generally to printing presses and more particularly to a device and method for providing a liquid to a cylinder of a printing press.

2. Background Information

Offset lithographic printing presses, for example, have a blanket cylinder for transferring images from a printing plate to a web of material, such as paper. Blankets on the blanket cylinder typically have a rubber outer print layer.

Especially after continued use, blankets in the printing press accumulate foreign matter such as dried ink, lint, dust, clay, dirt and the like which should be periodically removed by cleaning. When changing a print job, it may be desirable that the blankets are cleaned. Lack of proper cleaning can lead to poor print quality and reduced press productivity.

U.S. Pat. No. 5,257,578 discloses an automatic cleaning device for cleaning blankets in a web fed offset lithographic printing press. A brush roller is selectively applied to the blanket for removing foreign matter from the blanket. A blanket wash solution is applied to the brush roller in order to improve the cleaning of the blanket. U.S. Pat. No. 5,257,578 is hereby incorporated by reference herein.

The blanket wash solution for such devices is typically applied by a spray bar, which sprays a cleaning solution or solvent through a line of holes along the entire width of the brush. The spray bar cleaning solution thus is applied through the brush to the entire blanket when the blanket is cleaned. If the web in the printing press is the same width as the blanket, the cleaning of the entire blanket width is desirable.

However, it is often desired to print narrower web widths with an offset printing press. For example, even though a printing press could print a 57 inch web width, it may be desired to use the same press to print solely a 30 inch wide web, depending on the type of printed products desired. In this case, spray bar blanket wash systems will still spray cleaning solution across the entire 57 inch brush and blanket cylinder width. Since many cleaning systems rely on the web to remove the debris during the wash, the narrow 30 inch web will not readily remove debris and used cleaning solution from areas beyond the web width. Moreover, in the areas beyond the web width, the cleaning solution is still being applied and is not carried away by the web. In other words, a section of the blanket cylinder 27 inches wide is still receiving cleaning solution, even though no web is in that area.

The application of cleaning solution beyond the web width causes excess waste of cleaning solution or solvent, as the solvent exits as waste and is not reused. The disposal of the solvent, which may be environmentally sensitive material, can be expensive.

Moreover, the excess solvent can work its way into the narrow web during a print run, breaking down ink on the web and leading to print quality degradation. This degradation can cause paper waste, as the resulting printed products often have a washed out look or are unreadable and must be discarded.

European Patent Application No. 0 618 074 A2 purports to disclose a printing machine spraying device for spraying fluid having two emitters movable axially with respect to a printing cylinder. The fluid can be used to clean a blanket, and the emitters can be automatically controlled so as to be moved axially over the entire width or part of a desired width of the blanket cylinder, depending on how wide the printed material is.

The device of the '074 European patent application has a disadvantage in that the desired blanket width is not sprayed at one time, but rather in portions as the emitters move axially, thus requiring more time to coat the desired width. Moreover, the movement and control of the emitters requires a complex arrangement, which can be subject to malfunction or fouling.

BRIEF SUMMARY OF THE INVENTION

An object of the present invention is to provide for a reliable and efficient device and method for providing cleaning or other solution to a cylinder or part of a printing press.

The present invention provides a device for providing cleaning or other solution in a printing press comprising:

a spraying device, the spraying device having a liquid exit disposed along a width of the spraying device for delivering a liquid to a press component; and a spray shield selectively covering at least one part of the liquid exit so as to block delivery of the liquid through the at least one part to the press component.

The present invention permits instantaneous delivery of liquid, such as a cleaning solution, to the press component through the liquid exit, over variable widths, for example corresponding to a web width.

Preferably, the spraying device is a spray bar, the spray bar being at least as wide as the press component.

The press component preferable is a blanket cleaning brush or a blanket of an offset lithographic printing press.

Preferably, the liquid exit is a plurality of holes, and the at least one part is at least one of the holes disposed at one or both ends of the spray bar.

The spray shield preferably is at least one cylinder rotatable with respect to the spraying device, the cylinder having at least one aperture having a variable width.

In a first embodiment, the spray shield includes two rotatable cylinders, each at one end of the spray bar. Each has an aperture with a sloped or angled side for selectively covering a part of the liquid exit so as to narrow the effective spray area. The middle of the spray bar may remain unaffected by the cylinders. Alternately, if a narrow web is run at a side of the press, and not exactly in the middle, the spray shield may be a single cylinder with a sloped aperture can be provided on one side.

In alternate embodiments, the spray shield may have a single cylinder with a single aperture having sloped ends, or with a plurality of apertures with different widths.

The spraying device preferably is stationary, while the cylinder rotates around the spray bar. Preferably, the rotation is performed manually. However, the rotation may be effected by an air cylinder fixed at one end to the spray bar and at the other end to a follower which fits in a helical slot in the interior of the spray shield. The air cylinder motion thus rotates the spray shield. Most preferably, two air cylinders are provided, one having double the stroke length of the other, so that four equally spaced positions can be attained.

Preferably, a collection device collects the blocked liquid from the spray shield and returns it to a cleaning fluid reservoir.

The present invention also provides an offset lithographic printing unit with a plate cylinder, a blanket for contacting a plate on the plate cylinder and a blanket cleaning device. The blanket cleaning device includes a spraying device with a liquid exit disposed along a width of the spraying device for delivering a liquid, directly or indirectly, to the blanket, and a spray shield selectively covering at least one part of the liquid exit so as to block delivery of the liquid through the at least one part to the blanket.

Also provided is a method for providing cleaning or other fluid to a printing press component comprising the steps of spraying a fluid over a fixed width of a press component, and blocking part of the fluid over a part of the fixed width so that the part of the fluid does not reach the press component.

BRIEF DESCRIPTION OF THE DRAWINGS

Preferred embodiments of the present invention are described below by reference the following drawings, in which.

DETAILED DESCRIPTION OF THE PREFERRED EMBODIMENTS

Figure 1:
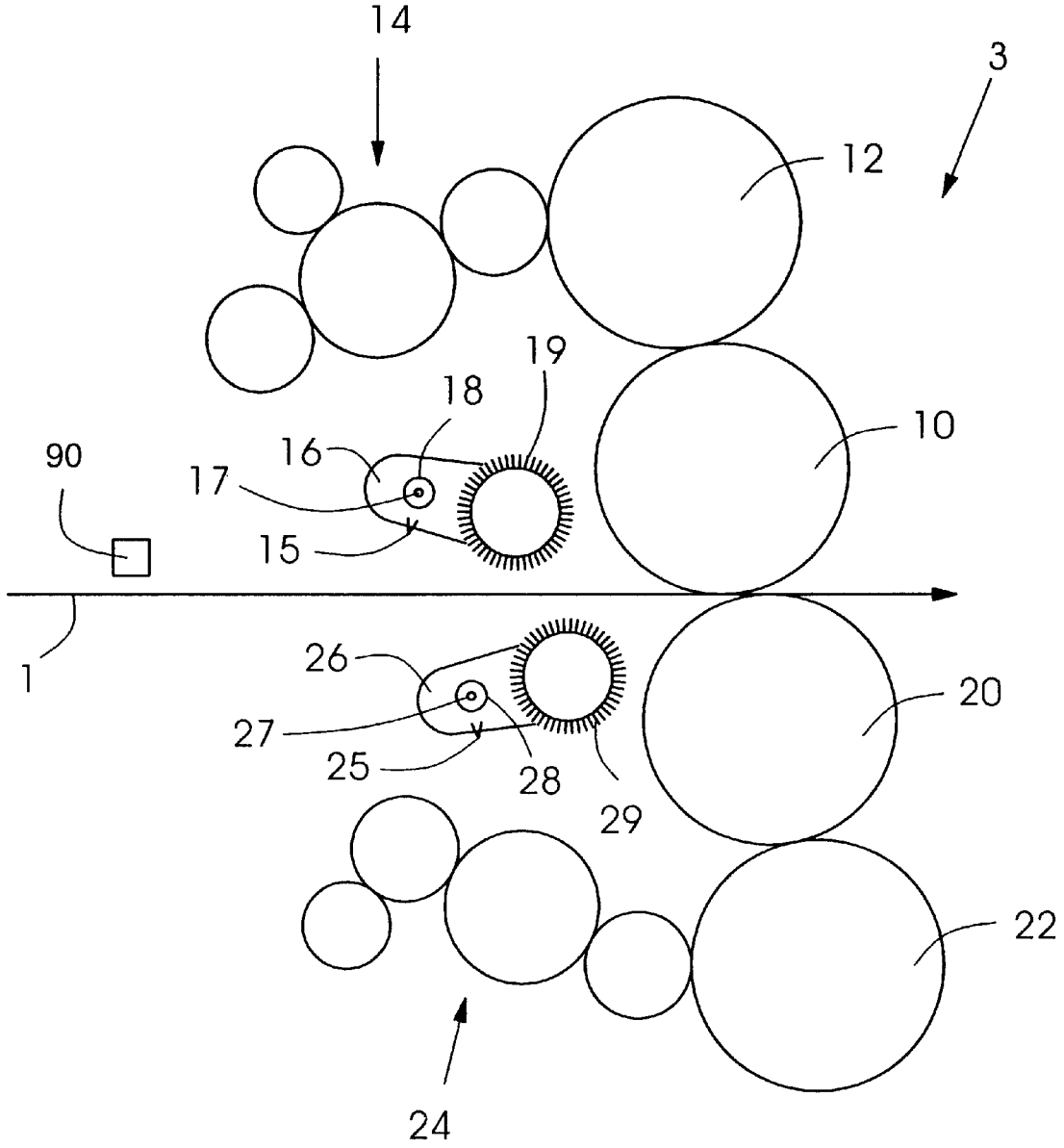
FIG. 1 shows a side view of a lithographic offset print unit having a blanket cleaning device according to the present invention.

FIG. 1 shows a preferred embodiment of the present invention used in an offset lithographic print unit 3. A web 1 passes through blanket cylinders 10, 20, which may have flat or tubular blankets fastened thereon. The blankets are contacted by plates on plate cylinders 12 and 22, respectively. Each plate cylinder is dampened with a dampening unit 14, 24.

During a printing operation, ink and dampening solution are applied to the plate cylinder 12, so that an image from the plate cylinder 12 is transferred to a blanket on blanket cylinder 10 and then to the web 1.

When a blanket on the blanket cylinder needs to be cleaned, cleaning devices 16 and 26 are moved into an engaged position with their respective blanket cylinders 10, 20. In the engaged position, brushes 19, 29 extending over the width of the blanket cylinders 10, 20, respectively, are engaged with the blankets. Brushes 19, 29 can rotate during a cleaning operation to clean the blankets.

During the cleaning operation, spray bars 17, 27 can spray a cleaning solution such as a solvent onto the brush, so that the brush is wet with the cleaning solution. The cleaning solution aids in removal of ink build-up and other foreign particles on the blankets. The cleaning solution may be water.

The spray bars 17, 27 spray liquid through apertures in spray shields 18, 28, respectively. Depending on the width of the web 1, spray shields 18, 28 are set so that the spray from the spray bars 17, 27 passes through an aperture width corresponding to the web 1 width. An optical sensor 90 can sense the web width and provide a feedback to an automatic setting device of the spray shields 18, 28.

Any excess cleaning solution blocked by the spray shields 18, 28 collects in the bottom of the cylindrically shaped shield and may be collected by collection devices 15, 25, which may return the cleaning fluid to a supply reservoir. The spray shields 18, 28 may be slightly sloped or have sloped drainages to aid in collection of the blocked cleaning fluid.

Figure 2:
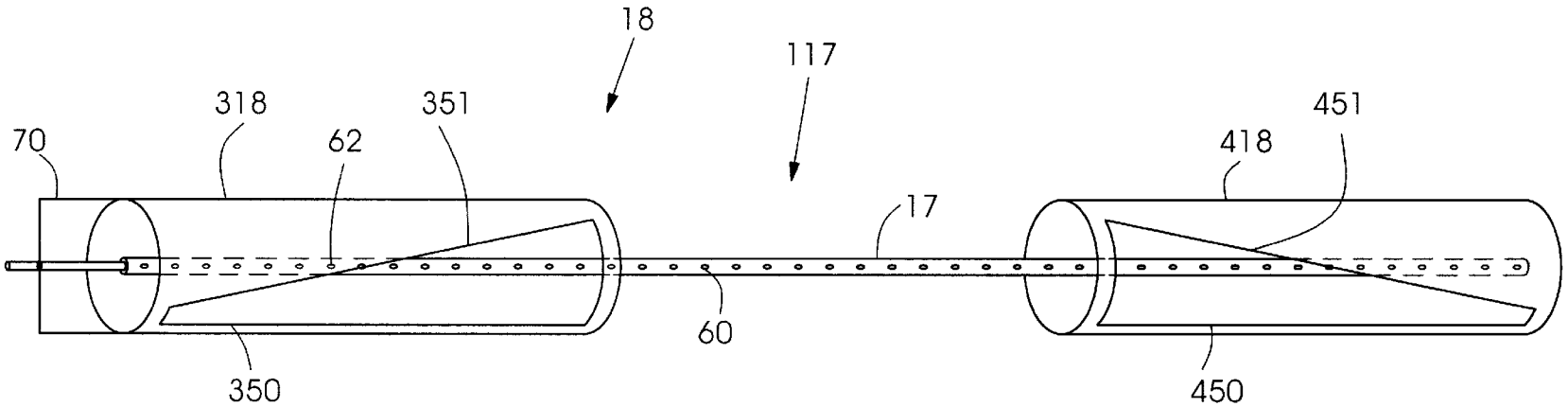
FIG. 2 shows a first embodiment of the device according to the present invention.

As shown in FIG. 2, in a preferred embodiment spray shield 18 includes two cylinders 318, 418. Each cylinder surrounds an end of the spray bar 17, which preferably as exits has a plurality of holes 60 spaced evenly along the width of the spray bar 17. An non-surrounded portion 117, preferably about a third of the width of the spray bar 17, may remain between the cylinders 318, 418. Cylinder 318 has an aperture 350 with a sloped edge 351, and cylinder 418 has an aperture 450 with a sloped edge 451. Edges 351 and 451 are angled with respect to an axis of spray bar 17.

Cylinders 318 and 418 are rotatable about spray bar 17, and may be supported about spray bar 17, for example by bearings. A manual setting device 70 can rotate cylinder 318 so that spray from holes 62 at one end of spray bar 17 is blocked by cylinder 318 from reaching a brush or the blanket of the press. After a desired rotation of the cylinder 318, the setting device 70 can be locked in position, for example using a screw tightener. Depending on the rotation of the cylinder 318, sloped edge 351 causes the spray of more or fewer of holes 60 to be blocked so as to alter the spray width. Cylinder 418 can be connected via rods which do not interfere with holes 60 so as to rotate with cylinder 318. Alternately, cylinder 418 could have its own setting device.

The web 1 traditionally runs in the middle of blanket cylinders 10, 20, regardless of width. However, in an alternate embodiment, cylinder 418 is not present, and web 1 runs on a side of the press and blanket cylinders 10, 20 corresponding to the location where cylinder 418 would have been. A single cylinder 318 thus can set the width of the spray reaching blanket cylinders 10, 20.

Figure 3:
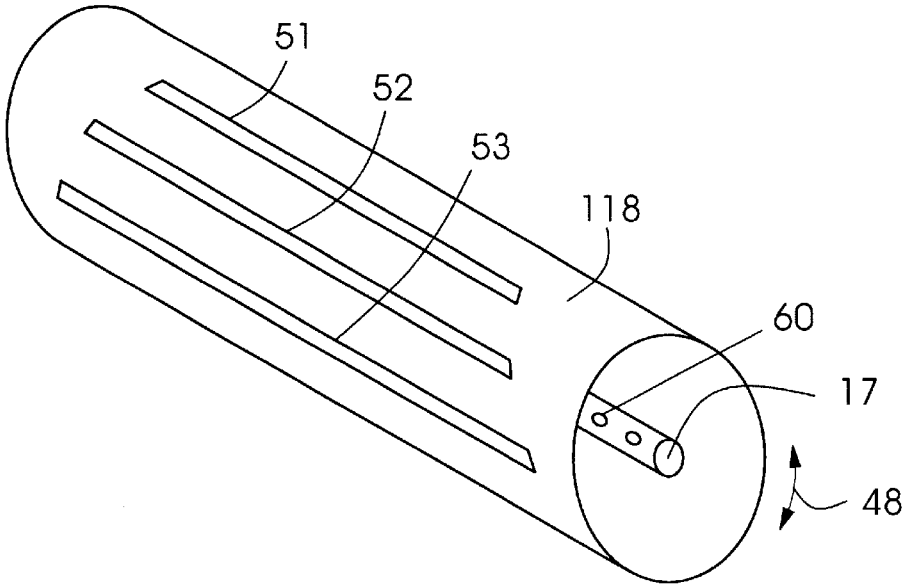
FIG. 3 shows a second embodiment of the device according to the present invention.

FIG. 3 shows an alternate embodiment according to the present invention with a spray shield 118 having a plurality of apertures 51, 52, 53, each with a different width. Preferably each of the widths corresponds to a common web width. The shield 118 can be rotated as shown by arrow 48 with respect to the spray bar 17, and set, so that holes 60 of spray bar 17 spray liquid through the desired aperture 51, 52, 53. Holes 60 extend the entire width of spray bar 17 and preferably are arranged in a linear fashion.

Figure 4:
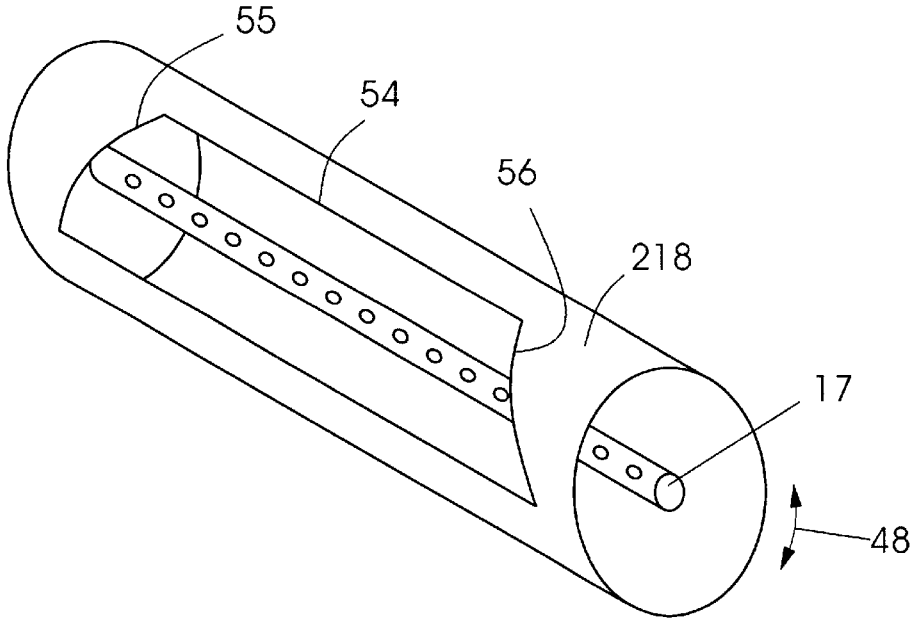
FIG. 4 shows a third embodiment of the device according to the present invention.

FIG. 4 shows another alternate embodiment of a spray shield 218, having an aperture 54 with angled edges 55, 56. Depending on the angle of rotation of the shield 218 with respect to spray bar 17, spray is blocked by edges 55, 56 as the spray exits through aperture 54.

The rotation of shields 18, 118, 218 can occur either manually or through an automatic rotation device, one embodiment of which is shown with respect to FIG. 4.

Figure 5:
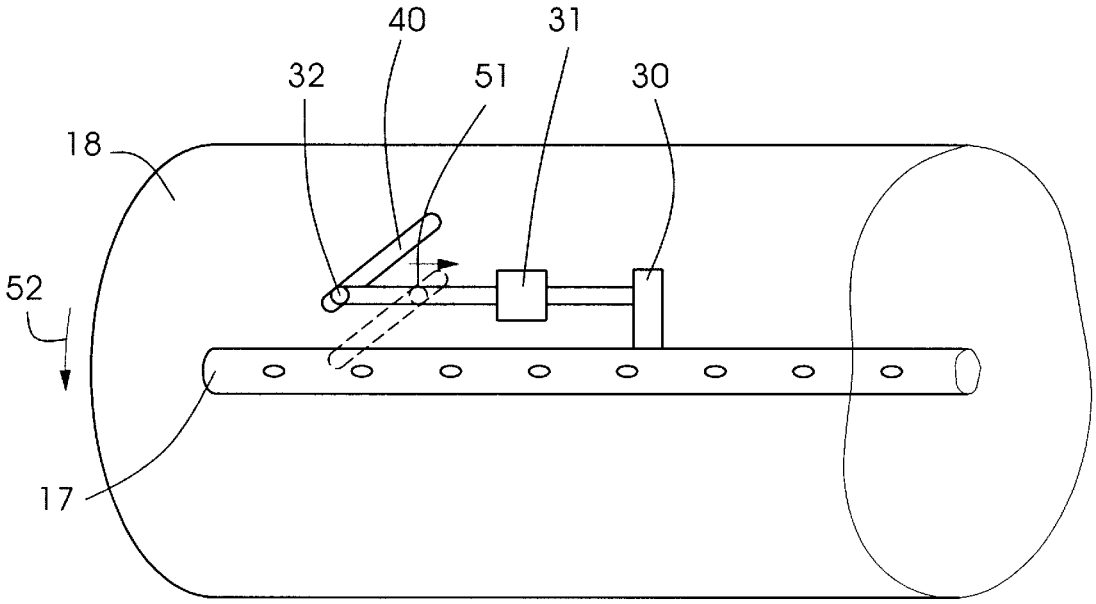
FIG. 5 shows details of an automatic actuating device for the device according to the present invention.

In FIG. 5, a support 30 for an air cylinder 31 is fixed to spray bar 17 (or to another fixed part), and a follower 32 is attached to the other end. The follower 32 sits in a helical slot 40 on the interior of shield 18. The air cylinder 31 can move between two positions, and when the cylinder 31 retracts in direction 51 from the position shown in FIG. 5, the action of the follower 32 in the slot causes the shield 18 to rotate in direction 52 to a second position. Preferably, two air cylinders are connected in series, so that four positions of shield 18 may be attained.

However, the shield 18 can also be moved manually and set using, for example, a screw tightening mechanism. The shield 18, 118, 218 can be continuously movable or have preferred rotational positions, for example determined by a ball detent mechanism. Other types of automatic setting mechanisms, such as a simple gear connected to a motor at one end of shield 18, could also be provided.

Moreover, the shield could include slidable slats for changing the width of the aperture of the shield, or other movable spray blocking mechanism.

While the exit for the liquid in the spray bar has been shown as a plurality of holes, a single thin slit could also provide the exit.

It should also be understood that the shields 18, 118, 218 are shown for clarity in the Figures at a larger distance from the spray bar 17 than desired. It is preferable that the clearance between spray shield 18, 118, 218 and the spray shield be less than an inch, and preferably less than 0.5 of an inch. However, at least some clearance is preferred (but not necessary), so that the pressure of spray exiting the unblocked portion of the spray bar exit does not significantly increase. Such a pressure increase could cause more spray than desired to be delivered to the blanket.

What is claimed is:

1. A device for providing cleaning or other solution in a printing press comprising:

a spraying device, the spraying device having a liquid exit disposed along a width of the spraying device for delivering a liquid to a press component, the spraying device having an axis: and a spray shield selectively covering part of the liquid exit so as to block delivery of the liquid through the part to the press component, the spray shield being a cylinder surrounding the spraying device and being rotatable with respect to the spraying device, the cylinder having at least one aperture having a variable axial width, the cylinder having a first rotational position where the liquid from the liquid exit passes through the at least one aperture at a first width and a second rotational position different from the first rotational position where the liquid passes through the at least one aperture at a second width different from the first width.

2. The device as recited in claim 1 wherein the part is at one or both ends of the liquid exit, so that a width of the liquid delivery can be set.

3. The device as recited in claim 1 wherein the spraying device is a spray bar, the spray bar being at least as wide as the press component.

4. The device as recited in claim 1 wherein the press component is a blanket cleaning brush or a blanket of an offset lithographic printing press.

5. The device as recited in claim 1 wherein the liquid exit is a plurality of holes, and the part is at least one of the holes disposed at one or both ends of the spraying device.

6. The device as recited in claim 1 further comprising an automatic setting device for setting the spray shield to allow for spray of different widths.

7. The device as recited in claim 1 wherein the at least one aperture is a single aperture having at least one sloped edge.

8. The device as recited in claim 1 wherein the at least one aperture includes a first aperture having the first width and a second aperture having the second width, the first and second apertures spaced circumferentially from each other about the cylinder.

9. The device as recited in claim 6 further comprising a sensor for sensing a web width, the sensor providing a feedback to the automatic setting device.

10. The device as recited in claim 1 further comprising a collection device for collecting the blocked liquid from the spray shield.

11. The device as recited in claim 1 wherein the spraying device is stationary within the device.

12. The device as recited in claim 1 wherein the spray shield is manually settable.

13. A device for providing cleaning or other solution in a printing press comprising:

a spraying device, the spraying device having a liquid exit disposed along a width of the spraying device for delivering a liquid to a press component; and a spray shield selectively covering part of the liquid exit so as to block delivery of the liquid through the part to the press component, the spray shield includes two cylinders, each cylinder having an aperture having a variable width.

14. The device as recited in claim 13 wherein the two cylinders are at ends of the spraying device and are separated by a non-blockable portion of the spraying device.

* * * * *